US006947524B2

(12) United States Patent
Steinlage et al.

(10) Patent No.: US 6,947,524 B2
(45) Date of Patent: Sep. 20, 2005

(54) TARGET BORE STRENGTHENING METHOD

(75) Inventors: Gregory Alan Steinlage, Milwaukee, WI (US); Liqin Wang, Brookfield, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 149 days.

(21) Appl. No.: 10/249,719

(22) Filed: May 2, 2003

(65) Prior Publication Data

US 2004/0218726 A1 Nov. 4, 2004

(51) Int. Cl.[7] ..... H01J 35/10
(52) U.S. Cl. ..... 378/144
(58) Field of Search ..... 378/125, 143, 378/144

(56) References Cited

U.S. PATENT DOCUMENTS 4,145,632 A * 3/1979 Devine, Jr. ..... 378/144
4,920,551 A * 4/1990 Takahashi et al. ..... 378/125
5,349,626 A * 9/1994 Ujari et al. ..... 378/144
6,163,593 A * 12/2000 Koller et al. ..... 378/144

* cited by examiner

*Primary Examiner*—Craig E. Church
*Assistant Examiner*—Thomas R. Artman
(74) *Attorney, Agent, or Firm*—Peter Vogel

(57) ABSTRACT

An x-ray tube target assembly 16 provided. The target assembly 16 includes a target plate element 18 having an impact surface 24, a target rear surface 30, an inner target bore 22, and an outer target circumference 38. The target plate element 18 defines a target plate depth 32 between the impact surface 24 and the target rear surface 30. The target rear surface 30 is formed such that the target plate depth 32 tapers from an increased target plate depth 34 at the inner target bore to a decreased target plate depth 36 at the outer target circumference 38. The target assembly 16 further includes a graphite base element 28 having a base upper surface 42 and a base rear surface 44. The base upper surface 42 is formed to mate with the target rear surface 30.

12 Claims, 1 Drawing Sheet

TARGET BORE STRENGTHENING METHOD

BACKGROUND OF INVENTION

The present invention relates generally to an x-ray tube target assembly, and, more particularly to a composite target assembly with improved thermal and mechanical robustness.

X-ray tubes are well known and widely utilized in a variety of medical imaging fields, medical therapy fields, and material testing and analysis industries. They are commonly comprised of both an anode assembly and a cathode assembly. X-rays are produced when electrons are released in a vacuum with the tube, accelerated and then abruptly stopped. The electrons are released from a heated filament. A high voltage between the anode and the accelerates the electrons and causes them to impinge on the anode. The anode is also referred to as the target since the electrons impact the anode at the focal spot.

In order to dissipate the heat generated at the focal spot, X-ray tubes often incorporate a rotating anode structure. The anode in these arrangements commonly comprises a rotating disc so that the electron beam constantly strikes a different point on the target surface. Although these methods can reduce the concentration of heat at a single spot on the target surface, there is still considerable heat generated within the target. The rotating disc and rotating shaft assembly may, therefore, be exposed to high temperatures in addition to significant temperature fluctuations between operational states. These temperature fluctuations, in addition to the mechanical stresses associated with rotation of the target disc, can expose the components of a target assembly to considerable induced stresses.

Present x-ray tube target geometries consist of planar disks that extend from the bore of the target outward. Material strain in the bore region can be of significant concern. Material strain in the bore region may cause loss of balance in mechanically attached target-stud joints. It may also result in cap to graphite separation in the case of composite metal-graphite targets. As the performance demands of x-ray tubes are increased, the operating stresses generated by thermal and mechanical loadings on target assemblies will continue to increase. Although these increasing operating stresses may be at least partially addressed through the variance of material properties of the target components, the continuously increasing performance requirements may quickly strain any material property limits.

It would, therefore, be highly desirable to have a target bore strengthening method whose methodology did not rely solely on the improvement of material property. It would be further desirable to have a target assembly with improved bore strength that was compatible with metal-graphite composite targets.

SUMMARY OF INVENTION

An x-ray tube target assembly is provided. The target assembly includes a target plate element having an impact surface, a rear surface, an inner target bore, and an outer target diameter. The target plate element defines a target plate depth between the impact surface and the rear surface. The rear surface is formed such that the target plate depth tapers from an increased target plate depth at the inner target bore to a decreased target plate depth at the outer target diameter. The target assembly further includes a graphite base element having a base upper surface and a base rear surface. The base upper surface is formed to mate with the target rear surface. Other features of the present invention will become apparent when viewed in light of the detailed description of the preferred embodiment when taken in conjunction with the attached drawings and appended claims.

DETAILED DESCRIPTION

Figure 1:
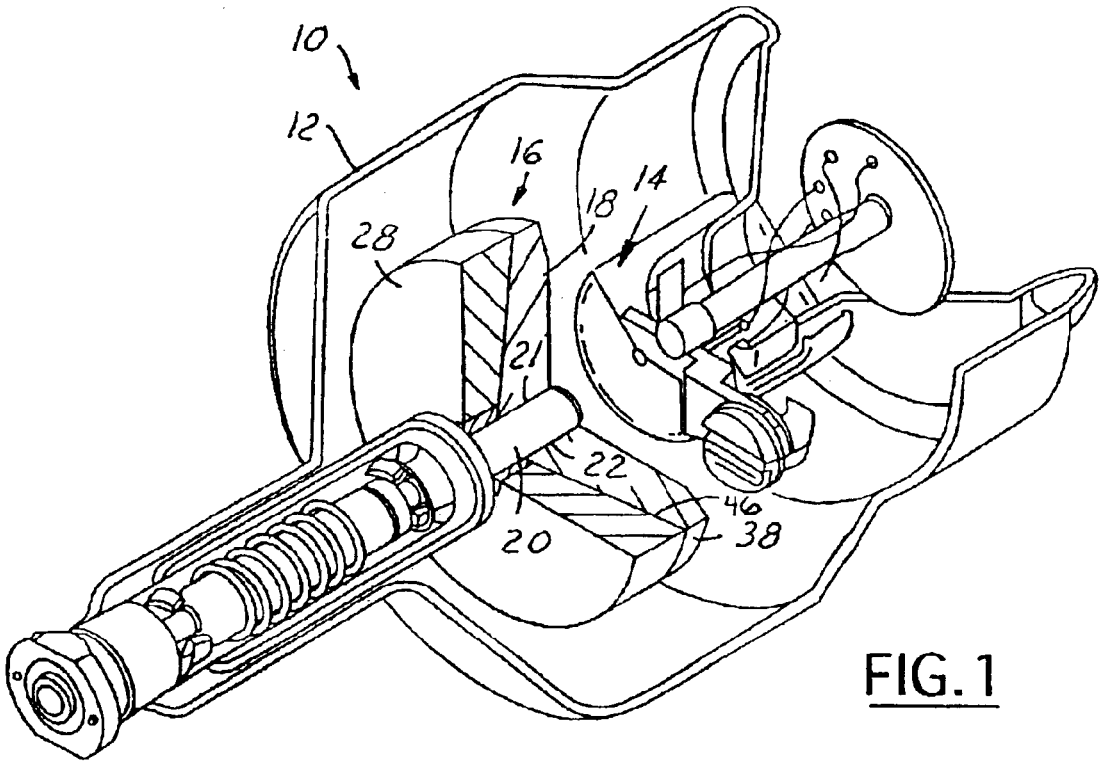
FIG. 1 is an illustration of an x-ray tube assembly in accordance with the present invention.

Referring now to FIG. 1, which is an illustration of an x-ray tube assembly 10 in accordance with the present invention. Although a specific x-ray tube assembly 10 is illustrated, it should be understood that the present invention is contemplated to be useful in a wide variety of x-ray tube assemblies. The x-ray tube assembly 10 includes an x-ray tube housing 12. Within the x-ray tube housing 12 resides a cathode 14. The cathode 14, when charged with an electric current, emits electrons. These electrons travel within the x-ray tube assembly 10 until they impact the anode/x-ray tube target assembly 16. Upon impacting the x-ray tube target assembly 16, the electrons generate x-rays. Such x-ray tube operation is well known in the art. Although the target disc element 18 may be comprises of a wide variety of materials, one embodiment contemplates that the target disc element 18 comprises metal.

It is also known, however, that excessive heat can generate in the target disc element 18 if the electrons continuously impact a single spot. The target assembly 16, therefore, includes a target shaft 20 positioned in and in communication with the target bore 22 of the target disc element 18. In this fashion, the target shaft 20 can be utilized to spin the target disc element 18 such that the electron stream from the cathode 14 continuously impacts different locations on the target impact surface 24 of the target disc element 18. Although the rotation of the target disc element 18 reduces localized temperature extremes, it introduces mechanical loading into the target assembly 16 in addition to the thermal loading induced by the impact of the electron stream. This is known to introduce mechanical and thermal strain to the inner target bore 22 where it is mounted to the target shaft 20, commonly through the use of a first braze 21. Material strain in this region is known to be a cause of loss of balance in a mechanically attached target disc element 18. Additionally, the mechanical and thermal loading can result in separation of the graphite base element 28 in the case of composite metal-graphite target assemblies 16.

Figure 2:
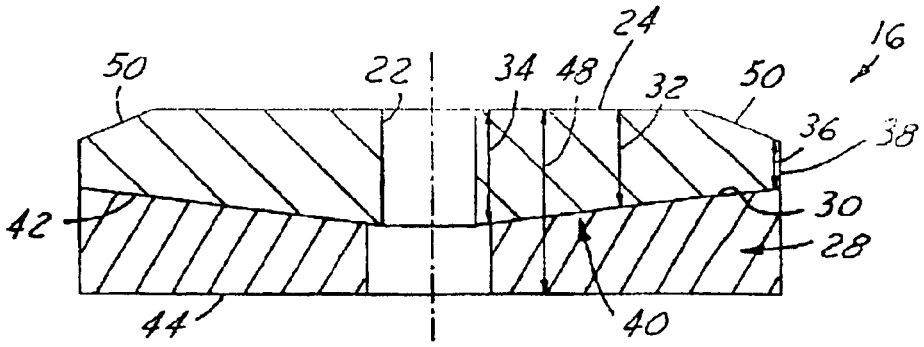
FIG. 2 is an illustration of an embodiment of an x-ray tube target assembly in accordance with the present invention, the x-ray tube target assembly for use in the x-ray tube illustrated in FIG. 1.

The present invention addresses these concerns by increasing the cross-sectional area of the inner target bore 22 without unduly increasing the mass of the target disc element 18. As stress is inversely proportional to cross-sectional area, higher area can result in lower stress. This is accomplished by forming a target rear surface 30 opposite the target impact surface 24 such that a target plate depth 32 is defined between the target rear surface 30 and the target impact surface 24. The target rear surface 30 is formed such that the target plate depth 32 tapers from an increased target plate depth 34 at the inner target bore 22 to a decreased target plate depth 36 at the outer target circumference 38. By utilizing the target rear surface 30 to control the target plate depth 32, the target impact surface 24 can remain optimally designed for receipt of electrons from the cathode 14. It is contemplated that the target rear surface 30 may be formed in a variety of configurations to produce such a described taper while resulting in an increased inner target bore 22 surface area. One such embodiment is illustrated in FIG. 2. In this embodiment, the target rear surface 30 is formed to produce a straight taper 40 running from the inner target bore 22 all the way out to the outer target circumference 38.

The present invention can further include a graphite base element 28 having a base upper surface 42 and a base rear surface 44. The base upper surface 42 is preferably formed to compliment the target rear surface 30 to facilitate bonding the graphite base element 28 to the target disc element 18. Although the graphite base element 28 may be attached to the base rear surface 44 in a variety of fashions, one embodiment contemplates brazing them together utilizing a second braze 46. It is further contemplated that the graphite base element 28 be formed such that after bonding to the target disc element 18, a uniform overall target assembly depth 48 is generated over the majority of the x-ray tube target assembly 16. It should be understood that the target disc element 18 may include an impact surface chamfer 50 positioned on the target impact surface 24 adjacent the outer target circumference 38. This impact surface chamfer 50 may impact the uniform overall target assembly depth 48 in a local area adjacent the outer target circumference 38, but is not intended to impact the majority of the target disc element 18.

Figure 3:
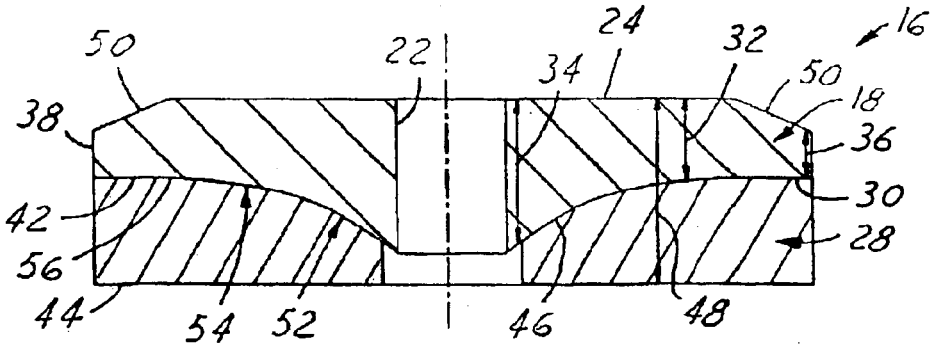
FIG. 3 is an illustration of an alternate embodiment of an x-ray tube target assembly in accordance with the present invention, the x-ray tube target assembly for use in the x-ray tube illustrated in FIG. 1.

Although the target rear surface 30 taper has thus far been described and illustrated in terms of a straight taper 40, it should be understood that a variety of tapers are contemplated that extend from the inner target bore 22 to the outer target circumference 38 (see FIG. 3). These tapers can include, but are not limited to, parabolic taper sections 52, straight taper sections 54, and flat sections 56. It is contemplated that these sections may be combined in any combination and in any order. Although the flexibility of arrangement of these sections is contemplated, it is preferable in one embodiment that the parabolic taper section 52 be positioned adjacent the inner target bore 22 to fully maximize the inner target bore 22 cross-sectional area and thereby maximize the cross-sectional area of the first braze 21. Similarly, by positioning either or both the parabolic taper section 52 and/or the maximum inner target bore 22 can be achieved while minimizing the mass of the target disc element 18.

Although the use of brazing techniques in general is well known within the art, it should be understood that the present invention provides the opportunity for unique applications of such techniques. For instance, the significant increase in cross-sectional area of the first braze 21 as has been discussed allows for a broader range of brazing materials and techniques and therefore has the potential to provide either cost or weight savings. In addition, it is contemplated that if the target rear surface 28 is formed to generate a straight taper arrangement, than the second braze 46 can be generated using either a conical formed braze foil or a braze foil cut from a flat sheet and then placed on the straight taper to form a cone shaped foil with a slit. This provides a practical method of inserting the brazing material into the second braze 46 prior to brazing operations. The conical shaped second braze 46 can be seen clearly in FIG. 1.

While particular embodiments of the invention have been shown and described, numerous variations and alternative embodiments will occur to those skilled in the arm. Accordingly, it is intended that the invention be limited only in terms of the appended claims.

What is claimed is:

1. An x-ray tube target assembly comprising:

a target plate element having an target impact surface, a target rear surface, an inner target bore, and an outer target circumference;

a target plate depth defined between said target impact surface and said target rear surface, said target rear surface formed such that said target plate depth tapers from an increase target plate depth at said inner target bore to a decreased target plate depth at said outer target circumference; and a graphite base element including a base upper surface and a base rear surface, said base upper surface formed to compliment and mounted to said target rear surface, said graphite base element combining with said target plate element to create a substantially uniform overall target assembly depth across the x-ray tube target assembly.

2. An x-ray tube target assembly as described in claim 1, wherein said graphite base element is brazed onto said target plate element.

3. An x-ray tube target assembly as described in claim 2, further comprising:

a conical shaped braze foil positioned between said graphite base element and said target plate element.

4. An x-ray tube target assembly as described in claim 1, wherein said target plate depth comprises a straight taper running from said inner target bore to said outer target circumference.

5. An x-ray tube target assembly as described in claim 1, further comprising:

a parabolic taper section formed as a portion of said target plate depth, said parabolic taper section positioned adjacent said inner target bore.

6. An x-ray tube target assembly as described in claim 1, further comprising:

an impact surface chamfer formed on said target impact surface, said impact surface chamfer positioned adjacent said outer target circumference.

7. An x-ray tube target assembly as described in claim 1, further comprising:

a target assembly drive shaft mounted to said target plate element at said inner target bore.

8. An x-ray tube target assembly comprising:

a target plate element having an target impact surface, a target rear surface, an inner target bore, and an outer target circumference;

a target plate depth defined between said target impact surface and said target rear surface, said target rear surface formed such that said target plate depth tapers from an increase target plate depth at said inner target bore to a decreased target plate depth at said outer target circumference, said target plate depth comprising a parabolic taper section, a straight taper section, and a flat section; and a graphite base element including a base upper surface and a base rear surface, said base upper surface formed to compliment and mounted to said target rear surface.

9. An x-ray tube target assembly as described in claim 8, wherein said parabolic taper section is positioned adjacent said inner target bore, said flat section is positioned adjacent said outer target circumference, and said straight taper section is positioned in between said parabolic taper section and said flat section.

10. An x-ray tube target assembly comprising:

a target plate element having an target impact surface, a target rear surface, an inner target bore, and an outer target circumference;

a target plate depth defined between said target impact surface and said target rear surface, said target rear surface formed such that said target plate depth tapers from an increase target plate depth at said inner target bore to a decreased target plate depth at said outer target circumference, said target plate depth comprising a parabolic taper section and a straight taper section; and a target assembly drive shaft mounted to said target plate element at said inner target bore.

11. An x-ray tube target assembly as described in claim 10, wherein said parabolic taper section is positioned adjacent said inner target bore.

12. A method of increasing the strength of an x-ray tube target assembly comprising:

increasing a target plate depth of a target plate element in a region of an inner target bore;

tapering said target plate depth from an increased target plate depth at said inner target bore to a decreased target plate depth in a region of an outer target circumference;

brazing a graphite base element to a target rear surface of said target plate element;

tapering a base upper surface of said graphite base element such that said base upper surface compliments said target plate;

placing a purely conical shaped braze foil between said graphite base element and said target plate element.

* * * * *